US005755530A

United States Patent [19]

Garren

[11] Patent Number: 5,755,530

[45] Date of Patent: May 26, 1998

[54] UNDERWATER CABLE BURIAL MACHINE HAVING IMPROVED CABLE LAYING APPARATUS

[75] Inventor: Donald Lee Garren, Winston-Salem, N.C.

[73] Assignee: AT&T Corp. Middletown, N.J.

[21] Appl. No.: 630,963

[22] Filed: Apr. 8, 1996

[51] Int. Cl.[6] ..... F16L 1/04

[52] U.S. Cl. ..... 405/159; 405/158; 405/174; 405/180

[58] Field of Search ..... 405/158–164, 405/174–183

[56] References Cited

U.S. PATENT DOCUMENTS

| | | | |
|---|---|---|---|
| 516,750 | 3/1894 | Blaine | 405/181 |
| 2,414,994 | 1/1947 | Wright | 405/181 X |
| 2,647,758 | 8/1953 | Ryan | 405/183 X |
| 3,405,533 | 10/1968 | Fries | 405/182 |
| 3,408,823 | 11/1968 | Okita et al. | 405/183 X |
| 3,429,134 | 2/1969 | Coffey | 405/181 X |
| 5,526,759 | 6/1996 | Cox | 405/180 X |

*Primary Examiner*—Dennic L. Taylor

[57] ABSTRACT

The cable laying apparatus, which solves many of the problems heretofore associated with existing cable laying mechanisms for underwater burial machines, uses a pivotally liftable depressor wheel, located within a feed shoe which tracks the groove cut by the plow. There are a pair of arcuate cable guides, one on each side of the depressor wheel, which assist in the guidance of both cables and bodies, without permitting either to bind. When the assembly to which the depressor wheel is attached is raised upward and rearward the guides prevent the cable from escaping while allowing a body to pass through the opening which is formed.

20 Claims, 5 Drawing Sheets

UNDERWATER CABLE BURIAL MACHINE HAVING IMPROVED CABLE LAYING APPARATUS

BACKGROUND OF THE INVENTION

The present invention relates to underwater cable burial machines. In particular, the invention relates to an underwater cable burying machine having an improved cable laying apparatus which includes a depressor wheel for guiding the cable into a groove cut in the seabed by a plow.

Underwater burial machines are used to bury communications cables in the sea bottom in an effort to protect the cables from damage. These machines plow a groove in the seabed beneath a body of water, and they simultaneously lay a cable into the groove which they have plowed. Burial machines use at least one plow blade to cut a groove into the seabed immediately in front of a cable laying mechanism. The cable is then placed into the groove thus formed in order that it will be somewhat beneath the surface of the seabed. After the cable has been laid into the groove, water pressure and underwater currents eventually cause the vertical walls of the groove to collapse and move sand and soil into the groove, thereby covering the cable and assisting in the overall burial operation.

A cable laying mechanism must ideally track the groove cut by the plow, and it must lay a cable into that groove. Periodically, however, i.e., every twenty to fifty miles, a device, called a "body", which may contain a repeater or other electronic apparatus, is attached to the cable. While the cables are relatively thin, i.e., typically about one-half inch in diameter, the bodies are typically several inches in diameter, and they may be up to about ten inches in diameter. Accordingly, it is important for the cable laying mechanism to be adapted to handle both the cable and the bodies, and it is important that in being able to handle bodies, the cable laying mechanism does not lose its ability to recapture the cable. Further, it is important to have a cable laying mechanism which does not readily permit the cable to bind following the passage of a body through the mechanism.

In view of the foregoing problems which were not solved by the cable laying mechanisms of the prior art, an improved cable laying mechanism which can overcome these problems would be desirable.

SUMMARY OF THE INVENTION

In accordance with the present invention, a new design approach has been disclosed which solves many of the problems heretofore associated with existing cable laying mechanisms for underwater burial machines. The new design uses an efficient configuration of a pivotally liftable depressor wheel, located within a cable feed shoe which tracks the groove cut by the plow. A pair of arcuate cable guides, one on each side of the depressor wheel, assist in the guidance of both cables and bodies, without permitting either to bind.

DETAILED DESCRIPTION OF THE PREFERRED EMBODIMENT OF THE INVENTION

Figure 1:
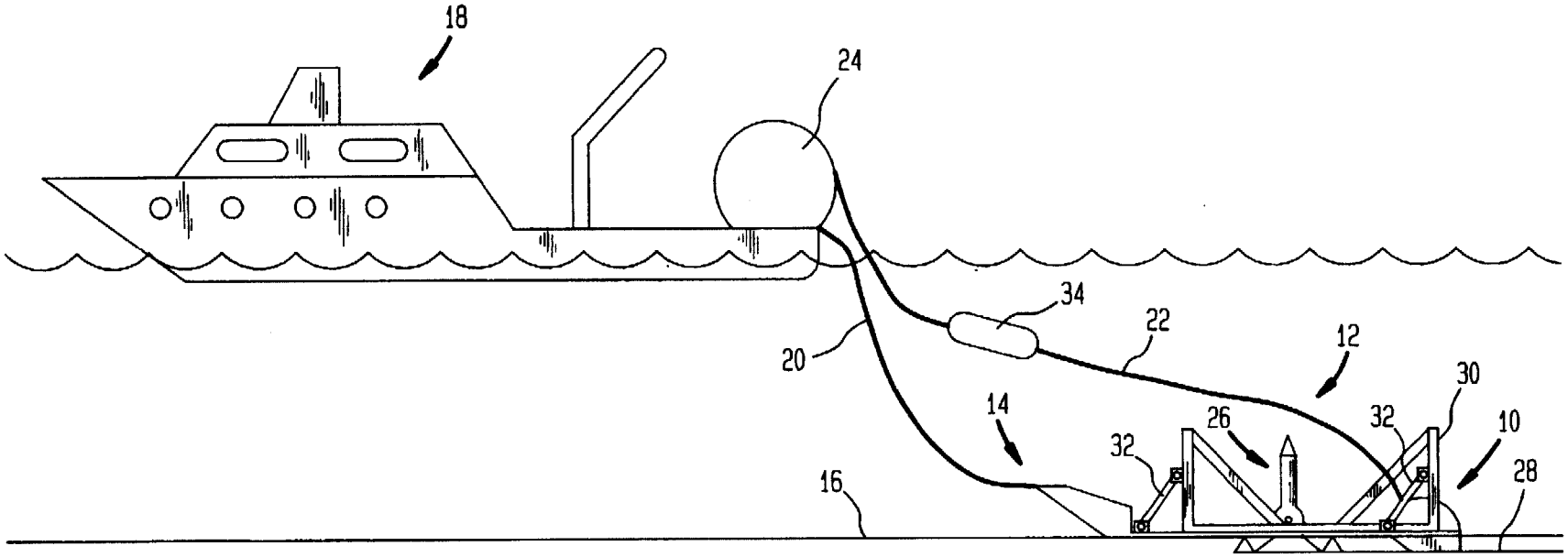
FIG. 1 is a side view illustrating the improved cable laying mechanism of the present invention on a cable burial machine being towed by a surface vessel in a cable laying operation.

Referring to FIG. 1, a simplified side view of the cable laying apparatus 10 of the present invention is shown in use on a cable laying machine 12 in a cable laying operation. The cable laying machine 12 is mounted on a sea sled 14 which is being towed along the seabed 16 by a surface vessel 18. The towing is accomplished by means of a combination towing/umbilical cable 20.

During the towing operation, a communications cable 22 is unspooled from a spool 24 on the vessel 18. As the sled 14 is pulled forward, a plow 26 cuts a groove 28 in the seabed 16, and the communications cable 22 is laid into the groove 28 by the cable laying apparatus 10 which is located on the rear of a carriage 30 which is fixed to the sled 14 using a four bar linkage 32. As will be understood by those skilled in the art, the four bar linkage 32 allows the carriage 30 to be moved up and down relative to the sled 12. This permits the plow 26 and cable laying apparatus 10, both of which are attached to the carriage 30, and both of which are shown to extend through the flat bottom of the sled 12, to be moved up and down relative to the bottom of the sled 12. The four bar linkage 32 allows the plow 26 and the cable laying apparatus 10 to be moved up above the bottom of the sled 12 when the sled 12 is recovered onto the deck of the vessel 18 for transportation or maintenance. In addition, the four bar linkage 32 can be used to adjust the depth of the groove 28 in the event that that becomes necessary due to the makeup of the seabed 16, i.e., if a rock layer is encountered below the surface of the seabed 16 at a depth which is less than the normal cable laying depth. By way of example, if the normal cable laying depth was twelve inches, and a rock layer was encountered ten inches below the surface of the seabed 16, then the four bar linkage 32 could be adjusted using hydraulic cylinders (not shown) so that the plow teeth only extended somewhat less than ten inches below the seabed 16, thereby preventing damage to the teeth while allowing the burial operation to continue.

As will be understood by those skilled in the art, the combination towing/umbilical cable 20 is used to both tow the sled 12, and to carry hydraulic fluid and electrical signals between the vessel 18 and the sled 12.

Periodically, i.e., every twenty to fifty miles, there will be a "body" 34 in the communications cable 22. The body 34 corresponds to a device, such as a repeater, or other electronic device, which is in-line with the communications cable 22, but which has a diameter which is substantially greater than the diameter of the communications cable 22. As used herein, the term "body" is meant to include any portion of the cable 22 having a diameter substantially wider than the remainder of the cable 22.

Figure 2:
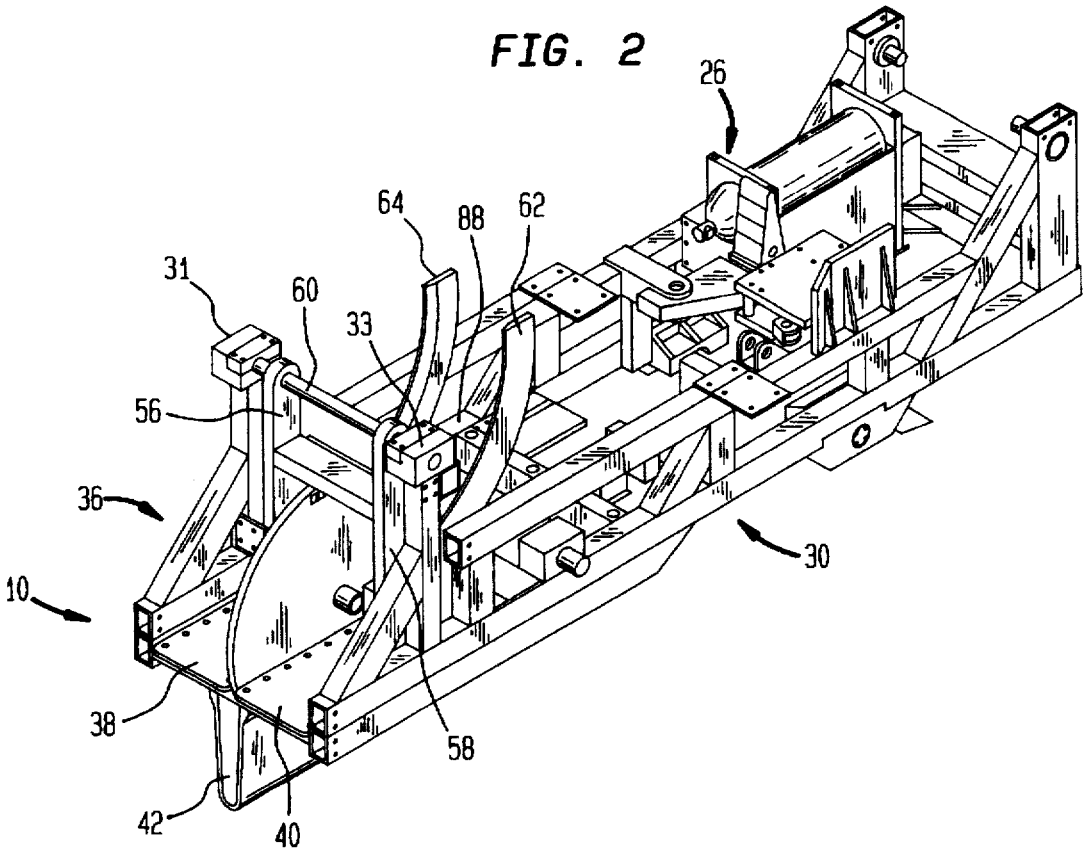
FIG. 2 is a perspective view of the carriage, showing the inventive cable laying mechanism installed.
Figure 3:
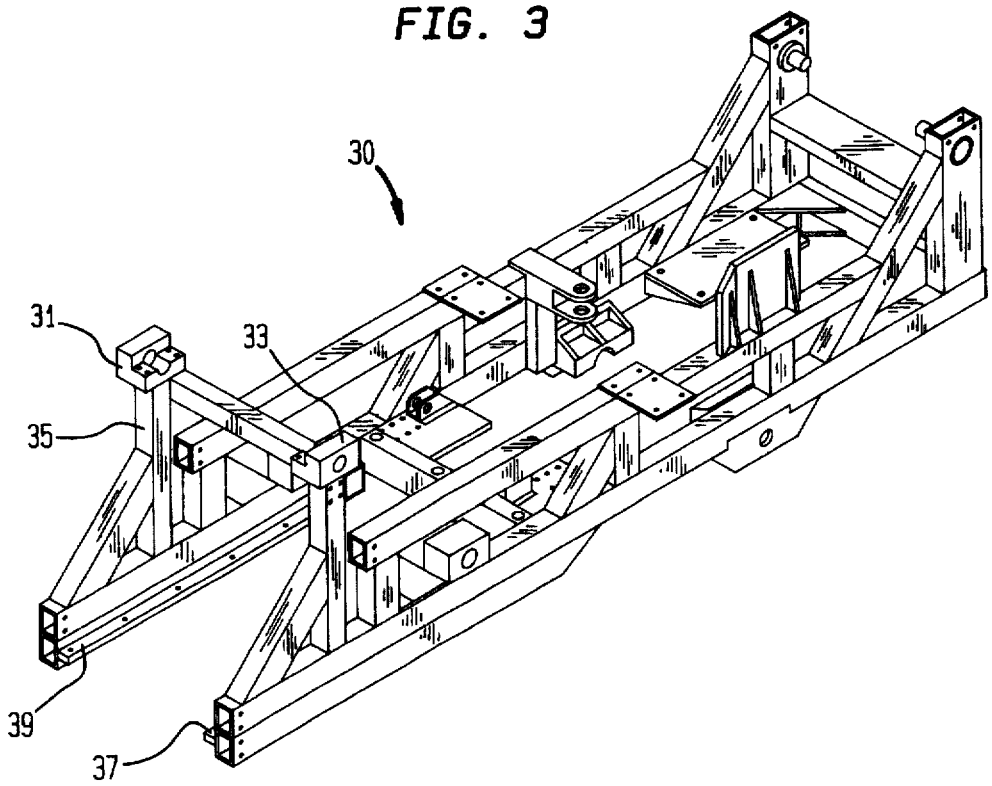
FIG. 3 is a perspective view of the carriage, with out the cable laying mechanism installed.
Figure 4:
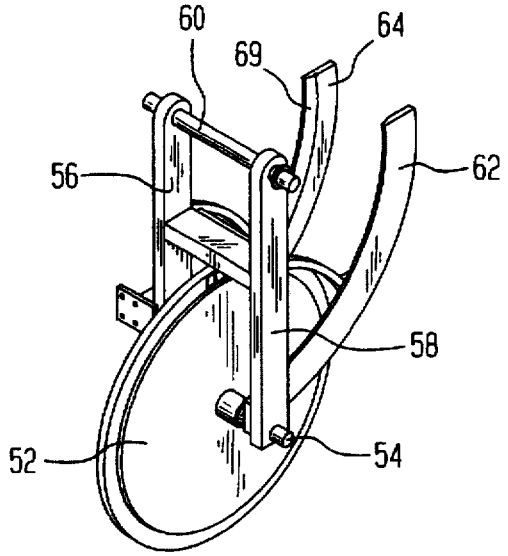
FIG. 4 is a perspective view of the depressor wheel assembly.

Referring to FIG. 2, a perspective view of the carriage 30, showing the cable laying apparatus 10 installed thereon, is shown. In FIG. 3 a perspective view of the carriage 30, without the cable laying apparatus installed, is shown. The cable laying apparatus 10 is comprised of a depressor wheel assembly 36, shown in FIGS. 2, 4 and 7–10, and a feed shoe assembly 38, shown in FIGS. 2, 5 and 6.

Figure 5:
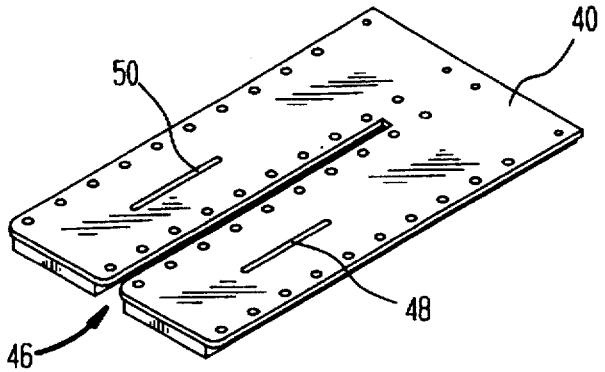
FIG. 5 is a perspective view of the top plate of the feed assembly, showing the guide rail grooves.
Figure 6:
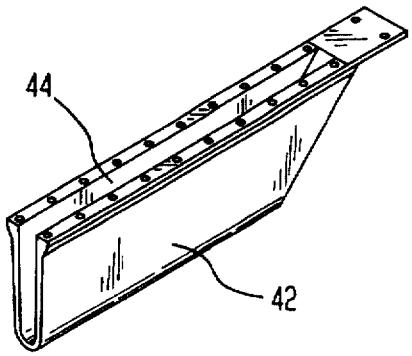
FIG. 6 is a perspective view of the feed shoe.
Figure 7:
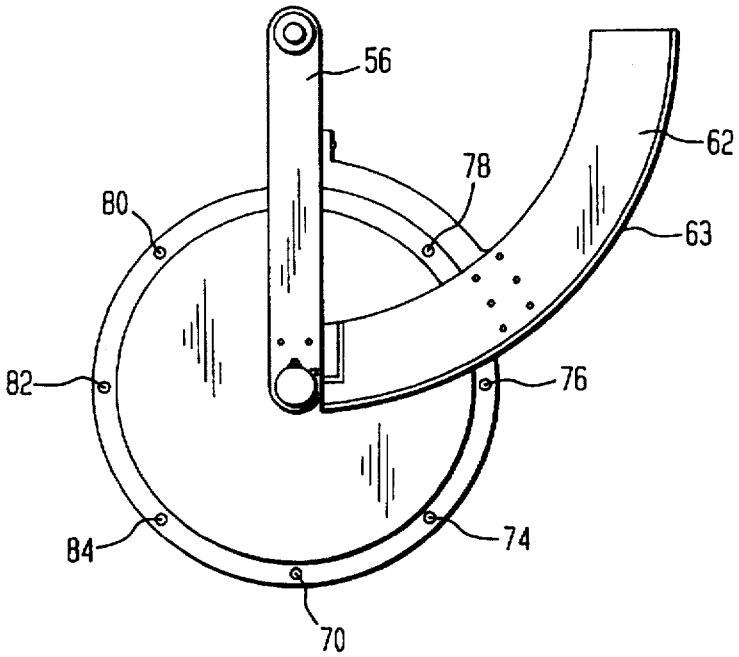
FIG. 7 is a side view of the depressor wheel assembly.

With reference to FIG. 3, the carriage assembly 30 is made of welded steel construction. At the aft part 35 of the carriage assembly 30, there are a pair of rails 37, 39 which are used to mount the feed shoe assembly 38. As shown in FIGS. 5 and 6, the feed shoe assembly 38 is comprised of an elongated feed shoe 42 which is used to guide the cable into the groove 28 formed by the plow 26 (See FIG. 1), and a top plate 40, which is the support member for the feed shoe 42. The feed shoe 42, which is closed at the front, has an elongated U-shaped opening 44 formed therein to receive the cable 22. The opening 44 extends through the top and rear of the feed shoe 42 (See FIG. 6), and it is adapted to receive the cable 22 and to lay it into the groove 28 formed in the seabed 16, as the feed shoe 42 is pulled through the groove 28. In the preferred embodiment of the invention, the closed front of the feed shoe 42 forms an angle of about 30° with the seabed (See FIGS. 1 and 6), as this has been found to be the optimal angle for minimizing the collection of debris by the feed shoe 42.

Similarly, the top plate 40 has an elongated opening 46, which extends through the rear of the top plate 40, and a pair of elongated guide rail grooves 48, 50 are formed in the top plate 40. The cable 22 is fed through the openings 44, 46, and the elongated guide rail grooves 48, 50 are used to guide the depressor wheel assembly 36, when it is pivoted upward and out of the feed shoe 42, as will be explained below.

Referring to FIG. 2, the depressor wheel assembly 36 includes a depressor wheel 52 which fits through the opening 46 in the top plate 40 and extends into the feed shoe 42 in normal cable laying operations. The depressor wheel 52 is mounted on a rotatable depressor wheel assembly 36, shown in FIG. 4 to include a depressor wheel axle 54, around which the depressor wheel 52 rotates. A pair of depressor wheel support brackets 56, 58, which hang from a pivoting wheel assembly support axle 60, are used to support the depressor wheel axle 54. The wheel assembly support axle 60 hangs from vertical members 31, 33 affixed to the carriage 30 (See FIGS. 1 and 2). The wheel assembly support axle 60 attaches the depressor wheel assembly 36 to the carriage 30, and supports the depressor wheel support brackets 56, 58, while allowing them to pivot around the axle 60.

Figure 8:
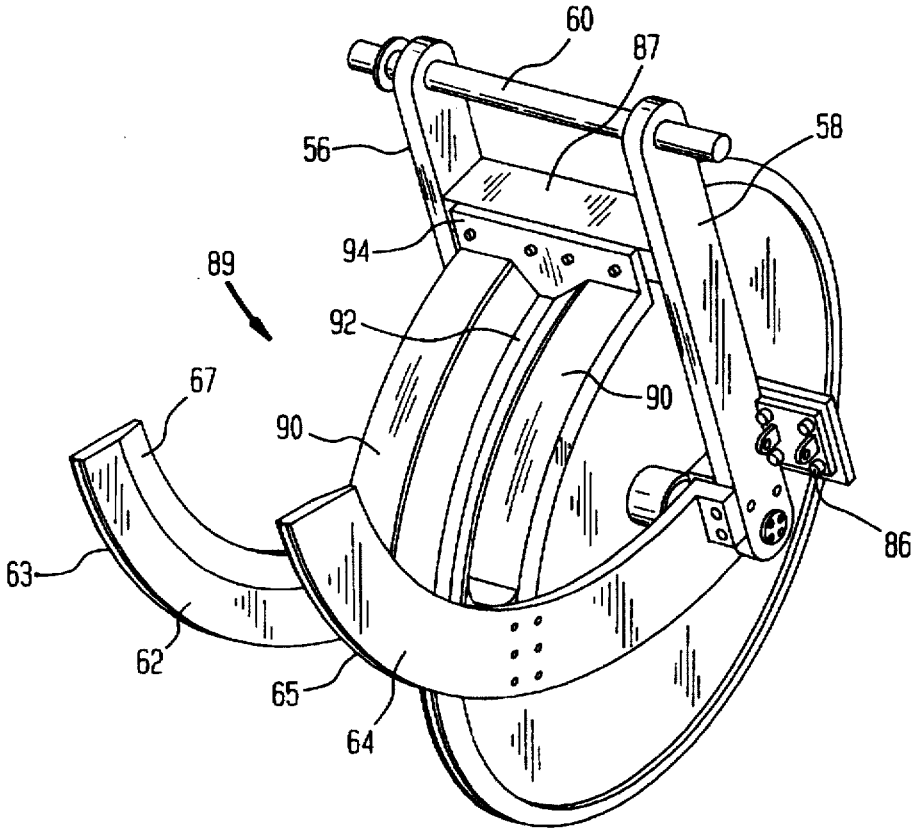
FIG. 8 is a perspective view of the front of the depressor wheel assembly.
Figure 9:
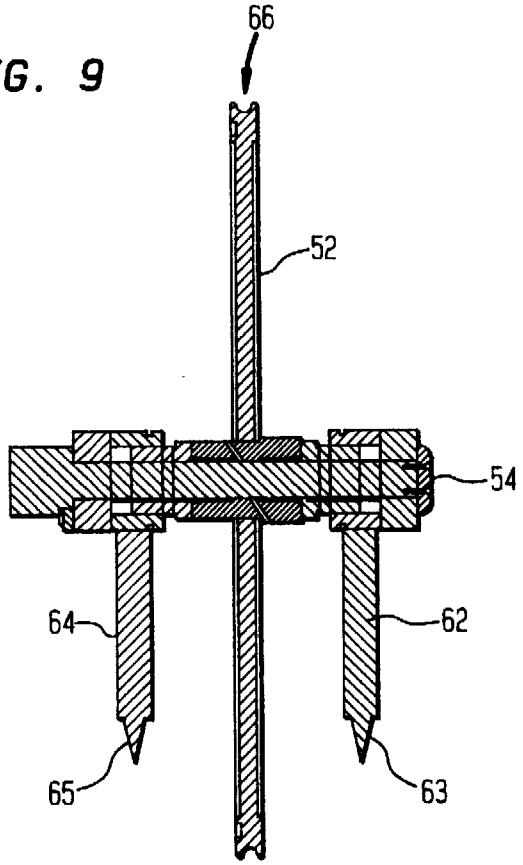
FIG. 9 is cross-sectional view of a portion of the depressor wheel and the cable guides.

On either side of the depressor wheel 52, there are tusk shaped, arcuate cable guides 62, 64. With reference to FIGS. 8 and 9, the outer peripheries of the cable guides 62, 64 include elongated V-shaped guide rails 63, 65, respectively. The V-shaped guide rails 63, 65 ride in the elongated guide rail grooves 48, 50 formed in the top plate 40 (See FIG. 5).

Referring primarily to FIG. 8, the forward side of the depressor wheel assembly 36 includes a cable guiding bridge assembly 89 made up of a formed steel piece having a pair of "flat" portions 90, with a deep V-shaped portion 92 joining them together. The bridge assembly 89 terminates at a plate 94 which is shaped to fit both the flat portions 90, and the V-shaped portion 92. The bridge assembly 89 is attached to a support brace 87, which joins the depressor wheel support brackets 56, 58. The cross-sectional shape of the bridge assembly 89, together with the cable guides 62, 64, riding in the guide rail grooves 48, 50 in the top plate 40, insures that the cable 22 must pass into the feed shoe assembly 38.

A clevis 86, shown in FIG. 8, is attached to the bracket 58. A hydraulic cylinder 88, shown in FIG. 2, is attached to the carriage 30. A shaft (not shown) extends from the hydraulic cylinder 88 and attaches to the clevis 86. Accordingly, hydraulic pressure may be used to extend the shaft, whereby the depressor wheel assembly 36 will be pivoted upward and rearward relative to the sled 12 (around the axle 60) when a body 32 must be passed through the wheel assembly 36. This pivoting action removes the depressor wheel 52 from the rear of the feed shoe assembly 38, but the cable guides 62, 64 will continue to ride on their guide rails 63, 65, which remain in the guide rail grooves 48, 50 in the top plate 40. Consequently, what was formerly a narrow opening (between the bottom of the depressor wheel 52 and the bottom of the feed shoe assembly 38) for the cable 22, can be made into a much larger opening (i.e., between the top plate 40 and the raised depressor wheel assembly 36) to allow the body 32 to pass therethrough, yet it still remains a closed opening from which the cable 22 cannot escape. After the body 32 has passed through the raised depressor wheel assembly 36, the depressor wheel assembly 36 is lowered, and the depressor wheel 52, with the aid of the bridge assembly 89 and the cable guides 62, 64, will recapture the cable 22 in the feed shoe 40 for additional cable laying. Cammed surfaces 67, 69 on the cable guides 62, 64 (See FIGS. 4 and 8), assist in guiding the cable 22 and the body 32.

Figure 10:
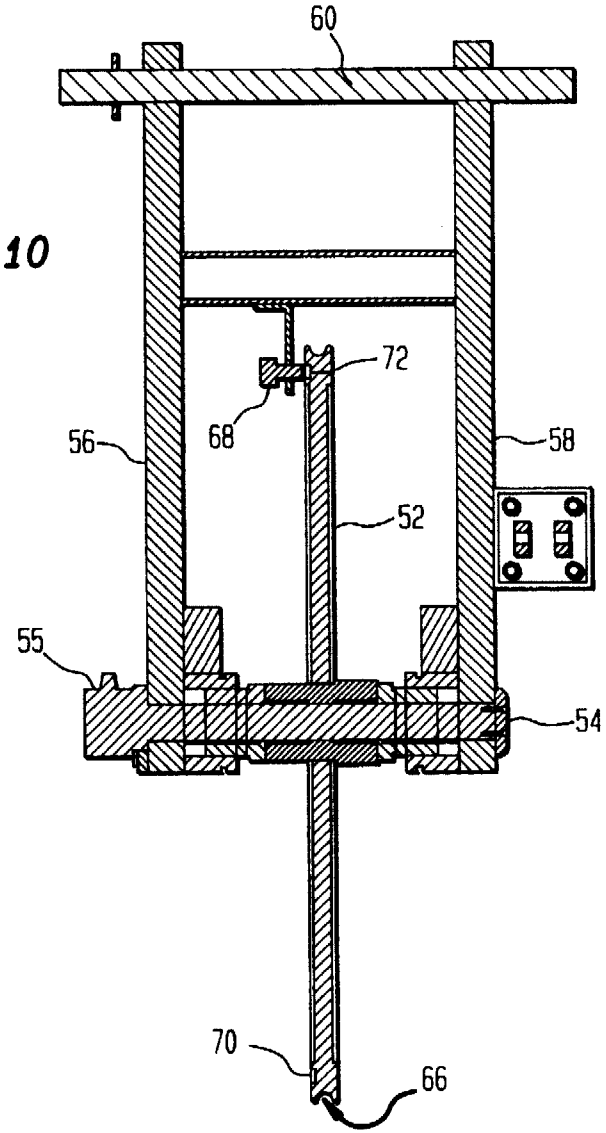
FIG. 10 is a cross-sectional view of the depressor wheel and the depressor wheel supports.

With reference to FIGS. 9 and 10, additional features of the present invention will be explained. As shown in cross section, the depressor wheel 52 has a groove 66 formed in its periphery. The groove 66 has a cross-section which is shaped to receive the cable 22.

The wheel also has a series of magnets 70, 72 (FIG. 10), and 70, 74, 76, 78, 80, 82, 84 (FIG. 7) installed around its rim. While eight magnets are illustrated, in the preferred embodiment of the invention, sixteen equally spaced magnets are presently used. The magnets 70–84, each cause a Hall effect sensor 68 (FIG. 10), which is attached to bracket mounted on support brace 87, to generate an electrical signal as the depressor wheel 52 turns. As most cable laying operations progress at a speed in the range of about one-half to three knots, the combination of the magnets and the sensor 68, will supply sufficient data to determine (within about one-tenth of a knot) the speed at which the cable laying operation is progressing.

Another feature of the present invention is that the axle 54 includes a "METROX" load pin 55, manufactured by M/D Totco of Texas. This device 55, which is made of strain gauges, is able to measure the residual cable tension, which is the tension to which the cable 22 is subjected due to the weight of the cable 22 in the water, and other factors. As the tension on a fiber optic cable must be limited to something less than about 4,000 pounds, the data from sensor 55 allows an operator on board the surface vessel 18 to monitor the tension on the cable 22. The particular sensor 55 which is used in the preferred embodiment of the invention is able to measure a tension of up to about 5,400 pounds, i.e. an amount far greater than that to which the cable 22 should ever be subjected.

As will be obvious to those skilled in the art, numerous changes can be made to the preferred embodiment of the invention without departing from the spirit or scope of the invention described herein.

I claim:

1. A cable burial machine comprising:

a feed shoe assembly for guiding a cable into a groove;

a rotatable depressor wheel assembly means extending into said feed shoe assembly for depressing said cable into said feed shoe assembly; and wherein said depressor wheel assembly means is able to rotate rearward and upward out of said feed shoe assembly to permit a body larger than said cable to pass between said rotatable depressor wheel assembly and said feed shoe assembly.

2. The cable burial machine of claim 1, wherein a depressor wheel is mounted on said depressor wheel assembly, wherein said depressor wheel assembly is pivotally mounted to said cable burial machine.

3. The cable burial machine of claim 2 wherein said feed shoe assembly further comprises:

an elongated feed shoe having a U-shaped opening formed therein, said feed shoe being adapted to receive said cable for burial and to guide said cable into said groove formed by said burial machine.

4. The cable burial machine of claim 3 wherein said U-shaped opening is closed at the front of said elongated feed shoe, and opened at the top and rear of said elongated feed shoe to receive said cable.

5. The cable burial machine of claim 4 wherein said depressor wheel fits into said opening formed at the top of said elongated feed shoe, to depress said cable into said feed shoe.

6. The cable burial machine of claim 5 wherein said depressor wheel rotates on a depressor wheel axle, and said depressor wheel axle is attached at either end to a pair of depressor wheel support members.

7. The cable burial machine of claim 6 wherein said depressor wheel support members are pivotally supported by a wheel assembly support axle which is attached, at each end to a pair of depressor assembly support members affixed to said cable burial machine.

8. The cable burial machine of claim 7 wherein said depressor wheel assembly further comprises a pair of arcuate cable guide members which are attached to said depressor wheel support members for guiding said depressor wheel assembly when rotating rearward and upward out of said feed shoe assembly.

9. The cable burial machine of claim 8, wherein said cable guide members include guides formed around their peripheries which include guide rails which are adapted to ride in a pair of guide rail grooves formed at the top of said feed shoe.

10. The cable burial machine of claim 9 further comprising a cable guiding bridge assembly formed between said cable guide members.

11. The cable burial machine of claim 1 further comprising means for calculating the speed at which said machine is traveling over a surface.

12. The cable burial machine of claim 11 wherein said calculating means comprises a plurality of magnets attached to said depressor wheel and a sensor which can sense the passage of a magnet, wherein said sensor is located in close proximity to said depressor wheel.

13. The cable burial machine of claim 12 wherein said sensor is a Hall effect sensor.

14. The cable burial machine of claim 1, further comprising means for sensing the tension on said cable.

15. The cable burial machine of claim 14 further comprising a depressor wheel axle around which said depressor wheel rotates, wherein said means for sensing the tension on said cable comprises strain gauges attached to said depressor wheel axle.

16. A cable burial machine comprising:

a means for guiding a cable into a groove;

a means for depressing said cable into said guiding means; and wherein said depressor means is able to rotate rearward and upward out of said guiding means to permit a body larger than said cable to pass between said depressor means and said guiding means.

17. The cable burial machine of claim 16, wherein said guiding means comprises a elongated feed shoe having a U-shaped opening formed at the top and rear of said feed shoe and is closed at the front of said feed shoe;

wherein said depressor means comprises a rotatable depressor wheel mounted on a depressor wheel axle attached at either end to a pair of depressor wheel support members; and wherein said rotatable depressor wheel extends into said feed shoe for depressing said cable into said feed shoe.

18. The cable burial machine of claim 17, wherein said depressor means further comprises:

a pair of arcuate cable guide members which are attached to said depressor wheel support members, said cable guide members include guides formed around their peripheries which include guide rails which are adapted to ride in a pair of guide rail grooves formed at the top of said feed shoe; and wherein said pair of arcuate cable guide members guide said rotatable depressor wheel rearward and upward out of said feed shoe to permit said body larger than said cable to pass between said rotatable depressor wheel and said feed shoe.

19. A cable burial machine comprising:

a feed shoe for guiding a cable into a groove, said feed shoe having a U-shaped opening formed at the top and rear of said feed shoe and is closed at the front of said feed shoe;

a depressor wheel assembly pivotally mounted to said cable burial machine, said depressor wheel assembly further comprises:

a rotatable depressor wheel fitting into said U-shaped opening formed at the top of said feed shoe, said rotatable depressor wheel is mounted on a depressor wheel axle; said depressor wheel axle is attached at either end to a pair of depressor wheel support members, said pair of depressor wheel support members are affixed to said cable burial machine; and wherein said depressor wheel is able to rotate rearward and upward out of said feed shoe to permit a body larger than said cable to pass between said rotatable depressor wheel and said feed shoe.

20. The cable burial machine of claim 19 further comprises:

a pair of arcuate cable guide members which are attached to said depressor wheel support members, said cable guide members include guides formed around their peripheries which include guide rails which are adapted to ride in a pair of guide rail grooves formed at the top of said feed shoe.

* * * * *